United States Patent [19]

Larson et al.

[11] 4,113,527

[45] Sep. 12, 1978

[54] CHROME STEEL CASTING

[75] Inventors: John Arden Larson, Easton; Robert Bowlby Fischer, Gouldsboro, both of Pa.

[73] Assignee: Ingersoll-Rand Company, Woodcliff Lake, N.J.

[21] Appl. No.: 819,355

[22] Filed: Jul. 27, 1977

[51] Int. Cl.[2] ..... C22C 38/12

[52] U.S. Cl. ..... 148/36; 75/124; 75/128 W; 148/37

[58] Field of Search ..... 148/36, 135, 37; 75/124, 128 W

[56] References Cited

U.S. PATENT DOCUMENTS

| | | | |
|---|---|---|---|
| 3,386,862 | 6/1968 | Johnston | 148/36 |
| 4,045,256 | 8/1977 | Fischer | 148/36 |

*Primary Examiner*—Arthur J. Steiner

*Attorney, Agent, or Firm*—Walter C. Vliet

[57] ABSTRACT

A low carbon Martensite transformation induced substructure, with nickel and molybdenum providing solid solution strengthening is obtained in a low chromium-nickel casting steel consisting of less than 0.06 percent C, 4.75 to 5.75 percent Cr, 2.75 to 3.50 percent Ni, 0.45 to 0.65 percent Mo, less than 1.0 percent Mn, less than 0.75 percent Si, 0.05 to 0.12 percent Al, and less than 0.04 percent of each P and S with the remainder essentially Fe with a specific double normalize heat treat and temper in conjunction with controlled chemistry, the resulting material has excellent impact properties. The weldability and foundry handling characteristics are excellent without preheat. It has superior tensile properties and significantly higher impact properties than the present ASTM A 217 Gr. C5 alloy which it can replace. In addition, it can replace several of the alloys in ASTM A 352.

4 Claims, 5 Drawing Figures

CHROME STEEL CASTING

BACKGROUND OF THE INVENTION

Specification ASTM A 217 Gr. C5 provides a nominal 5 percent chromium casting steel widely utilized in the industry for casting relatively large parts such as pump casings. One of the major shortcomings of this material is the fact that it requires preheat to prevent cracking when performing operations such as cutting off of gates and risers and welding.

In U.S. Pat. No. 4,045,256, issued Aug. 30, 1977, an improved 5 percent chromium alloy was disclosed which eliminated the cracking problem during cutting of gates, etc., and welding without preheat. Although the new alloy exhibited comparable impact properties to ASTM A 217 Gr. C5, some applications such as given in ASTM A 352 require better low temperature impact properties.

It is the object, therefore, of this invention to teach a modified nominal 5 percent chromium casting alloy having mechanical properties essentially equal to or superior to that of ASTM A 217 Gr. C5 including impact properties and does not require preheat for performing operations such as mentioned above.

It is further the object of this invention to provide a casting alloy that is less costly and troublesome to produce through the final stages of production flow through the foundry and machine shop.

Generally, the object of this invention is to teach a nominal 5 percent chromium casting alloy which is similar to ASTM A 217 Gr. C5 in chemistry, but has a lower carbon content, nickel additions, and a unique heat treatment for this type of alloy to achieve superior working properties, equal or superior tensile properties and superior impact properties.

Specifically, the object of this invention is to teach a nominal 5 percent chromium casting alloy similar to ASTM A 217 Gr. C5 but having a maximum carbon content of approximately 0.06 percent and nickel additions of nominally 3.0 percent, and which is manufactured with a unique heat treatment to provide superior impact properties.

Specifically, the object of this invention is to teach a 5 percent chromium casting alloy having a maximum carbon content of 0.04 percent, nickel additions of nominally 3 percent, maximum silicon content of 0.75 percent, and maximum aluminum content of 0.12 percent, and which is manufactured with an unique heat treatment to provide superior impact properties which can replace some of the alloys given in ASTM A 352; for example, LCA, LCB, LCC, LC1, and LC2.

Figure 1:
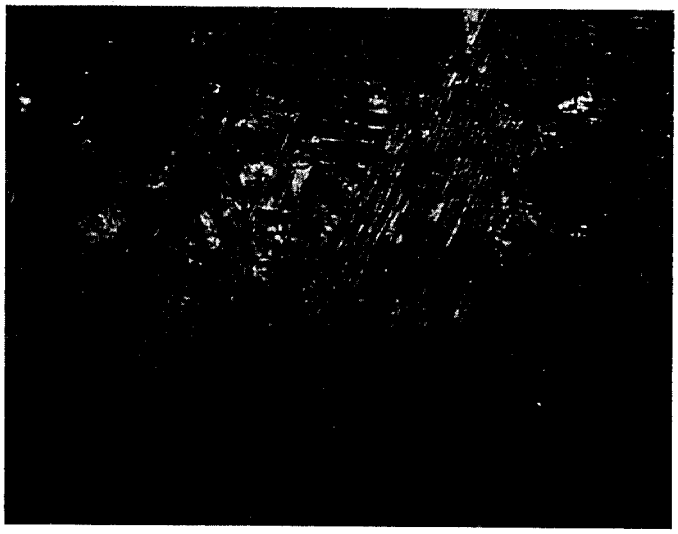
FIG. 1 shows the as-cast microstructure of an alloy according to this invention.

The spherical dot in each figure identifies the same location in the photomicrograph.

Sample preparation included machining and polishing down to 3 micron diamond paste. The etching occurs by oxidation after sample was heated. No chemical etching was utilized. The photomicrographs were taken at a magnification of 100.

DESCRIPTION OF THE PREFERRED EMBODIMENT

A comparison of the chemistry and mechanical properties of ASTM A 217 Gr. C5 and the present invention referred to as New Alloy are presented below.

CHEMISTRY

| Material | C | Mn | P | S | Si | Cr |
|---|---|---|---|---|---|---|
| ASTM A 217 Gr. C5 | 0.11/ 0.15 | 0.40/ 0.70 | 0.04× | 0.045× | 0.75× | 4.00/ 6.50 |
| New Alloy | 0.04× | 1.0× | 0.04× | 0.04× | 0.75× | 4.75/ 5.75 |

| Material | Mo | Ni | Cu | Al | W | Total Trace |
|---|---|---|---|---|---|---|
| ASTM A 217 Gr. C5 | 0.45/ 0.65 | 0.50× | 0.50× | — | 0.10× | 1.00× |
| New Alloy | 0.45/ 0.65 | 2.75/ 3.50 | — | 0.12× | — | 1.00× |

TENSILE PROPERTIES

| Material | 0.2YS (ksi) | TS (ksi) | Elong. (ksi) | Red of Area (ksi) | BHN |
|---|---|---|---|---|---|
| ASTM A 217 (Min) Gr. C5 | 60.0 | 90.0 | 18 | 35 | — |
| New Alloy (Average) | 78.6 | 102.4 | 22.8 | 63.5 | 215 |

IMPACT PROPERTIES

Charpy V-Notch - Ft. Lbs.

| Material | Room Temp | 25° F | 0° F | −50° F | −100° F |
|---|---|---|---|---|---|
| ASTM A 217 Gr. C5 | 49 | 27 | 19 | 9 | 5 |
| New Alloy Double Normalize | 74 | 49 | 40 | 28 | 18 |
| I-R Spec. 409 Single Normalize 1250° F Temper | 37 | 24 | 20 | 14 | — |

The low carbon content combined with nickel additions result in a material having a metallurgical structure known as low carbon martensite which gives the new alloy its excellent weldability and handling characteristics without preheat. The new alloy is similar to the Spec 409 alloy of U.S. Pat. No. 4,045,256, with a tighter specification of carbon, aluminum, and silicon additions. The novelty of the present invention resides primarily in the unexpected increase in impact properties resulting from a new heat treatment for this alloy. The heat treatment to obtain the improved properties consists of a double normalize and temper. For optimum impact properties, the austenizing temperature for the first normalize is approximately 1900° F. (1038° C.), the second normalize is carried out at approximately 1600° F. (871° C.), followed by tempering at a temperature of 1200° F. (649° C.).

CHEMISTRY

In the chemistry table above an "x" following the percentage indicates a maximum percentage and the slash between percentages indicates a range. Acceptable alloys made to this invention have contained from 0.02 to 0.06 percent carbon. It is believed that an acceptable alloy to this invention would contain the following percentages of critical elements:

Carbon 0.02 to 0.06 percent, manganese 0.4 to 1.0 percent, nickel 2.75 to 3.5 percent, chromium 4.75 to 5.75 percent, molybdenum 0.45 to 0.65 percent, silicon less than 0.75 percent, aluminum 0.05 to 0.12 percent, trace elements less than 1.0 percent total with the remainder essentially iron.

A new strong, tough, low carbon 5 percent chromium alloy has been developed, utilizing nickel as the primary element and molybdenum as a secondary element for strength. In the classical 5 percent chromium alloy (ASTM A 217 Gr. C5), carbon imparts strength. In the new alloy, the loss in strength due to the removal of carbon is restored by the use of nickel and to a lesser degree molybdenum, both of which impart strength due to solid solution hardening. The substitution of nickel and molybdenum for carbon, coupled with the other alloying elements are responsible for the improved characteristics and properties. It was found that a nominal composition of 3 percent nickel and 0.5 percent molybdenum gave the desired properties. The nickel greatly enhances the low temperature impact properties of the alloy and is much superior to ASTM A 217 Gr. C5. It compares favorably in impact properties with some of the alloys in ASTM A 352 at a higher strength level.

In addition to its solid solution strengthening effect, molybdenum also improves the tempering behavior and hardenability. It renders the alloy less susceptible to the detrimental effects which other elements, such as phosphorus, have on impact properties. The tempering behavior is improved with molybdenum, since it stabilizes the carbides. Molybdenum contributes markedly to deep hardening, a property known as hardenability. In this respect, it is second only to carbon. As a consequence, in sections where deep hardening is a controlling factor, it raises the endurance limit (fatigue strength) of steel and enhances other properties controlled by depth hardness. Molybdenum also raises the elevated temperature strength and improves resistance to creep.

Manganese improves the impact properties by combining with the sulfur to form manganese sulfide, thus removing the deliterious effect of sulfur.

To provide sufficient fluidity during casting and for deoxidation, a nominal silicon composition of 0.5 percent was chosen. It should be noted that silicon also provides some solid solution hardening. For good impact properties, the silicon must be kept below 0.75 percent.

Aluminum is added during the melting as a deoxidizer and improves impact properties when present at the 0.05–0.10 percent level. However, to prevent lower impact properties, it must be kept below 0.12 percent.

HEAT TREATMENT

Tensile Properties

The tensile properties shown above represent typical properties which are averages over a number of production heats. These properties were obtained using the chemical composition shown above. Although the tensile properties are a function of tempering temperature, they are relatively unaffected by normalizing treatment. Those shown above were obtained with a double normalizing consisting of a 1900° F. heat treatment for 1 hour per inch of thickness which was air cooled, followed by a 1600° F. heat treatment for 1 hour per inch of thickness which was air cooled. Similar properties can be obtained with a single normalize.

Impact Properties

Although the tensile properties are not appreciably affected by normalizing treatment, the impact properties are markedly affected by both the normalizing and tempering procedures. To obtain maximum impact properties, a double normalizing followed by the appropriate temper must be used.

Figure 2:
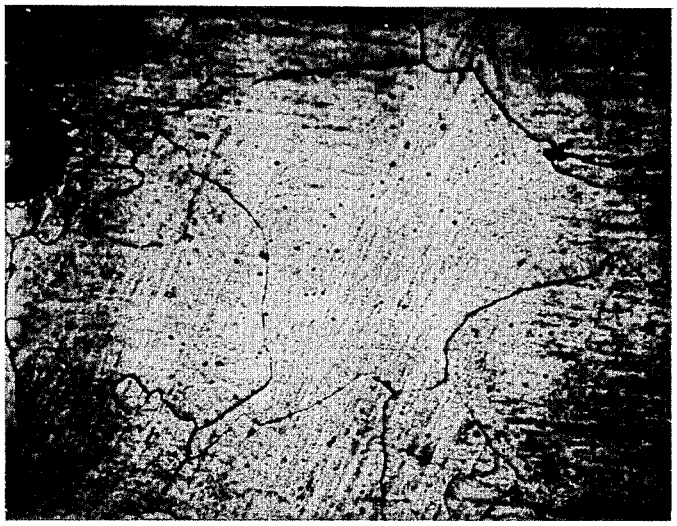
FIG. 2 shows the microstructure at the start of a 1900° F. (1038° C.) first normalizing.
Figure 3:
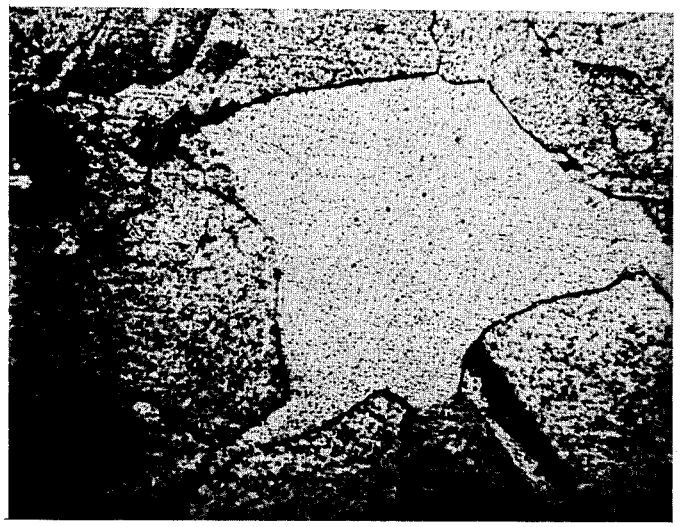
FIG. 3 shows the microstructure after 30 minutes of a 1900° F. (1038° C.) first normalizing.
Figure 4:
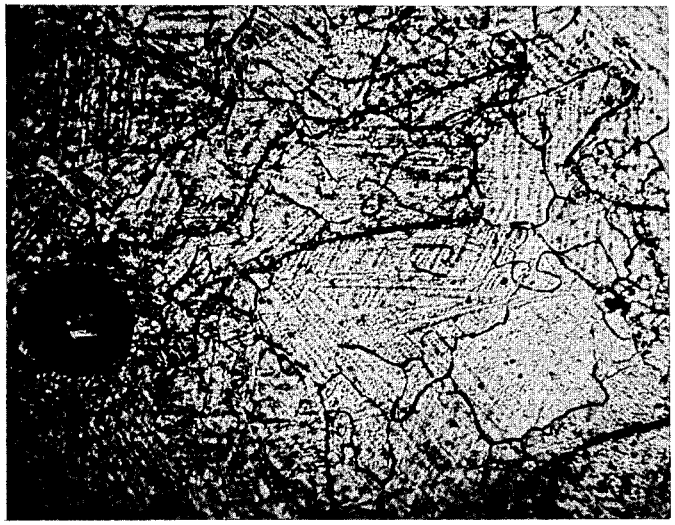
FIG. 4 shows the microstructure after 2 hours of a 1600° F. (871° C.) second normalizing.
Figure 5:
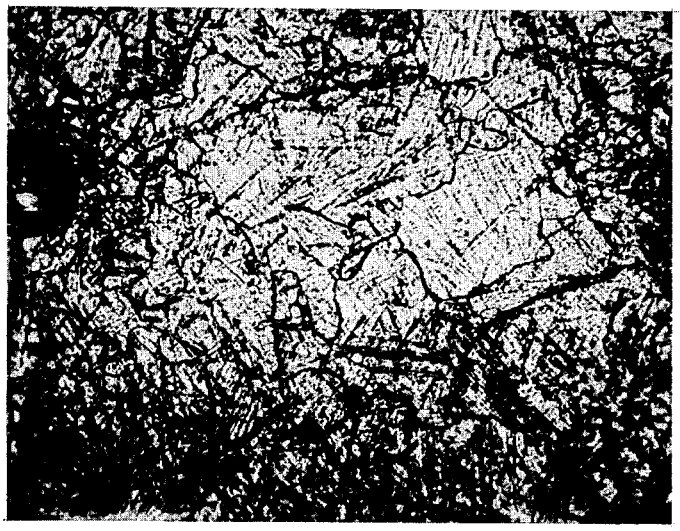
FIG. 5 shows the microstructure after 30 minutes of a 1200° F. (649° C.) temper.

Utilizing hot stage microscopy techniques and hardness and Charpy impact tests, the normalizing and tempering cycles to obtain the maximum properties have been determined. The first normalizing, which is done at 1900° F., breaks up the as-cast structure and converts it into austenite (See FIGS. 1, 2, and 3). Upon air cooling, the austenite transforms to a strained martensitic phase, known as lath martensite. Its formation is associated with heavy shear deformation during transformation as the material is cooled through the $M_s$–$M_f$ temperature range. During this transformation, small particles, which are probably carbides, have been observed within the lath boundaries. This strained martensite becomes the driving force for the second normalizing at 1600° F., which produces a fine grained recrystallized phase of austenite (See FIG. 4). Upon air cooling, the fine grained austenite transforms to fine grained lath martensite. The second normalizing is then followed by the appropriate temper, usually 1200° F. (See FIG. 5). It must be emphasized that these three temperatures must be selected very carefully. Both normalizing temperatures must be above the upper critical ($Ac_3$), since the structures must be converted to austenite.

The first normalizing must be sufficiently high to provide a driving force for the second normalizing, and the second normalizing must be high enough to convert the martensite to austenite, but not so high as to cause grain growth. The correct temperature for the second normalizing would be just above the upper critical temperature. The appropriate tempering temperature is dictated primarily by the desired tensil properties desired. However, in all cases it must be below the lower critical ($Ac_1$) to avoid reversion to austenite which would produce untempered martensite on cooling. To accommodate production variations in chemistry, an optimum tempering temperature of 1200° F. was selected.

In addition to the double normalizing treatment, to obtain maximum impact properties, several of the alloying elements (carbon, silicon, and aluminum) must be kept within certain maximum limits. To optimize toughness at a given strength level, it is mandatory to maintain the carbon at a minimum level (in the order of 0.04 percent), consistent with strength considerations. by alloying with nickel and molybdenum, the required strength can be obtained at carbon levels down to 0.02 percent. For maximum impact (toughness), carbon must be in the order of 0.04 percent maximum and silicon 0.75 percent maximum.

It is quite clear that a tempered, low carbon martensitic transformation induced substructive, with nickel and molybdenum providing solid solution strengthening, has effectively offset the lowering of carbon and will provide excellent tensile and impact properties. This alloy, with its nominal composition of 5 percent chromium, 3 percent nickel, 0.5 percent molybdenum and manganese, is indeed a remarkable combination of high strength, ductility and toughness as measured by tensile and impact tests. A comparison of the average tensile and impact properties for a number of heats of ASTM A 217 Gr. C5 and the new alloy with the single and double normalize is shown in the following table.

| Material | Yield Strength 0.2%-ksi | Tensile Strength ksi | Elongation Percent | Reduction of Area Percent | BHN | Charpy V-Notch Ft. Lbs.-Room Temp. |
|---|---|---|---|---|---|---|
| ASTM A 217 Gr. C5 | 74 | 97 | 22 | 62 | 220 | 49 |
| New Alloy Single Normalize 1825° F (996° C) Temper 1250° F (677° C) | 84 | 106 | 20 | 63 | 223 | 35 |
| New Alloy Double Normalize 1200° F (649° C) Temper | 79 | 102 | 23 | 64 | 215 | 74 |

The preceeding data represent optimum impact properties. Acceptable properties can be obtained with other combinations of normalizing and tempering temperatures, as shown in the following tables:

Effect of Tempering Temperature on Tensile and Impact Properties

| Tempering Temp. —° F | Yield Strength 0.2%-ksi | Tensile Strength ksi | Elongation Percent | Reduction of Area Percent | BHN | Charpy Impact Room Temp. Ft. lbs. |
|---|---|---|---|---|---|---|
| 1100 | 94 | 106 | 18 | 64 | 229 | 42 |
| 1150 | 86 | 101.5 | 21 | 66 | 215 | 60 |
| 1200 | 81 | 100 | 22 | 67 | 207 | 69 |
| 1250 | 82 | 103 | 21 | 63 | 212 | 68 |

Effect of First and Second Normalizing Temperatures 1250° F Temper

| Normalize Temp. | Yield Strength 0.2%-ksi | Tensile Strength ksi | Elongation Percent | Reduction of Area Percent | BHN | Charpy Impact Ft. lbs. |
|---|---|---|---|---|---|---|
| 1900/1600 | 82 | 103 | 21 | 63 | 212 | 68 RT 47 0° F |
| 1900/1650 | 71 | 99 | 22 | 60 | 207 | 63 RT 35 0° F |
| 1825/1600 | 78.5 | 102.5 | 21 | 63 | 212 | 64 RT 40 0° F |

FOUNDRY PRACTICE AND WELDING

Two of the primary advantages of this alloy over the presently used industry standard are related to foundry practice and welding. Since the beginning of production heats, all castings have been processed through the foundry by cutting off the gates and risers cold. By eliminating the usual practice of utilizing preheat, considerable cost savings are realized. In addition, normal welding is accomplished without preheat, which is not possible with the industry standard, C5.

We claim:

1. A chromium nickel casting manufactured from a steel consisting of:

| Ingredient | Wt. Percent |
|---|---|
| Carbon (C) | less than 0.06 |
| Manganese (Mn) | less than 1.0 |
| Phosphorus (P) | less than 0.04 |
| Sulfur (S) | less than 0.04 |
| Silicon (Si) | less than 0.75 |
| Aluminum (Al) | 0.05 to 0.12 |
| Chromium (Cr) | 4.75 to 5.75 |
| Molybdenum (Mo) | 0.45 to 0.65 |
| Nickel (Ni) | 2.75 to 3.50 |
| Iron (Fe) | essentially balance |

the finished casting manufactured to the standards of ASTM A 217 Gr. C5 and further having a first normalizing heat treatment at approximately 1900° F. (1038° C.) for 1 hour per inch of thickness, followed by air cooling to room temperature, followed by a second normalizing heat treatment at approximately 1600° F. (871° C.) for 1 hour per inch of thickness, followed by air cooling to room temperature, followed by a tempering at approximately 1200° F. (649° C.) for 2 hours per inch of thickness.

2. A chromium nickel casting manufactured from a steel consisting of:

| Ingredient | Wt. Percent |
|---|---|
| Carbon (C) | less than 0.04 |
| Manganese (Mn) | less than 1.0 |
| Phosphorus (P) | less than 0.04 |
| Sulfur (S) | less than 0.04 |
| Silicon (Si) | less than 0.75 |
| Aluminum (Al) | 0.05 to 0.12 |
| Chromium (Cr) | 4.75 to 5.75 |
| Molybdenum (Mo) | 0.45 to 0.65 |
| Nickel (Ni) | 2.75 to 3.50 |
| Iron (Fe) | essentially balance |

the finished casting manufactured to the standards of ASTM A 217 Gr. C5 and further for optimum impact properties having a first normalizing heat treatment at 1900° F. ± 25° F. (1038° C. ± 14° C.) for 1 hour per inch of thickness, followed by air cooling to room temperature, followed by a second normalizing heat treatment at 1600° F. ± 25° F. (871° C. ± 14° C.) for 1 hour per inch of thickness, followed by air cooling to room temperature, followed by a tempering at 1200° F. ± 15° F. (649° C. ± 8° C.) for 2 hours per inch of thickness.

3. A chromium nickel casting manufactured from a steel consisting of:

| Ingredient | Wt. Percent |
|---|---|
| Carbon (C) | less than 0.06 |
| Manganese (Mn) | less than 1.0 |
| Phosphorus (P) | less than 0.04 |
| Sulfur (S) | less than 0.04 |
| Silicon (Si) | less than 0.75 |
| Aluminum (Al) | 0.05 to 0.12 |
| Chromium (Cr) | 4.75 to 5.75 |
| Molybdenum (Mo) | 0.45 to 0.65 |
| Nickel (Ni) | 2.75 to 3.50 |

-continued

| Ingredient | Wt. Percent |
|---|---|
| Iron (Fe) | essentially balance |

the finished casting manufactured to the standards of ASTM A 217 Gr. C5 and further having a first normalizing heat treatment in the range of 1825° F. (996° C.) to 1900° F. (1038° C.) for 1 hour per inch of thickness, followed by air cooling to room temperature, followed by a second normalizing heat treatment in the range of 1600° F. (871° C.) to 1650° F. (899° C.) for 1 hour per inch of thickness, followed by air cooling to room temperature, followed by a tempering in the range of 1100° F. (593° C.) to 1250° F. (677° C.) for 2 hours per inch of thickness.

4. A chromium nickel casting manufactured from a steel consisting of:

| Ingredient | Wt. Percent |
|---|---|
| Carbon (C) | 0.04 |
| Manganese (Mn) | 0.5 |
| Phosphorus (P) | less than 0.04 |
| Sulfur (S) | less than 0.04 |
| Silicon (Si) | 0.5 |
| Aluminum (Al) | 0.075 |
| Chromium (Cr) | 5.0 |
| Nickel (Ni) | 3.0 |
| Iron (Fe) | balance |

the finished casting manufactured to the standards of ASTM A 217 Gr. C5 and further for optimum impact properties having a first normalizing heat treatment at 1900° F. (1038° C.) for 1 hour per inch of thickness, followed by air cooling to room temperature, followed by a second normalizing heat treatment at 1600° F. (871° C.) for 1 hour per inch of thickness, followed by air cooling to room temperature, followed by a tempering at 1200° F. (649° C.) for 2 hours per inch of thickness.

* * * * *